US006584209B1

(12) United States Patent
Wang

(10) Patent No.: US 6,584,209 B1
(45) Date of Patent: Jun. 24, 2003

(54) OPEN-TYPE MAGNETIC CIRCUITRY OF LOUDSPEAKER

(76) Inventor: Alex Wang, 4F, No. 155, Cheng-Kung Road Sec.4, Nei Hu District, Taipei (TW)

( * ) Notice: Subject to any disclaimer, the term of this patent is extended or adjusted under 35 U.S.C. 154(b) by 254 days.

(21) Appl. No.: 09/828,844

(22) Filed: Apr. 10, 2001

(51) Int. Cl.[7] ..... H04R 25/00

(52) U.S. Cl. ..... 381/412; 381/403; 381/405; 381/407; 381/419; 381/420; 381/400

(58) Field of Search ..... 381/403, 405, 381/407, 412, 419, 400, 420

(56) References Cited

U.S. PATENT DOCUMENTS 2,727,949 A * 12/1955 Lokkesmoe
4,427,845 A * 1/1984 Yoshida
5,740,265 A * 4/1998 Shirakawa
5,912,978 A * 6/1999 Eastty et al.
6,175,637 B1 * 1/2001 Fujihira et al.
6,269,168 B1 * 7/2001 Tagami
6,359,996 B1 * 3/2002 Ohashi

* cited by examiner

*Primary Examiner*—Rexford Barnie
*Assistant Examiner*—Dionne Harvey
(74) *Attorney, Agent, or Firm*—Michael D. Bednarek; Shaw Pittman LLP

(57) ABSTRACT

An open-type magnetic circuitry of loudspeaker includes a lower yoke having a central portion upward projected to form a bobbin, a magnet positioned on top of the bobbin, a voice coil wound around the bobbin and the magnet, and a diaphragm connected at a root portion to the voice coil. The magnetic circuitry of loudspeaker is characterized in that the lower yoke is provided at an upper side surrounding the bobbin with a plurality of radially equally spaced supporting posts, a top end of which being higher than at least a bottom side of the magnet, and that a ring-shaped upper yoke having a central hole is covered onto the top end of the supporting posts, such that heat produced by the voice coil during working could quickly dissipate via the spaces among the supporting posts. Since no heat would accumulate in the loudspeaker, the loudspeaker could always maintain good sound quality.

3 Claims, 5 Drawing Sheets

OPEN-TYPE MAGNETIC CIRCUITRY OF LOUDSPEAKER

BACKGROUND OF THE INVENTION

The present invention relates to an open-type magnetic circuitry of loudspeaker, and more particularly to a magnetic circuitry of loudspeaker enabling quick dissipation of internal heat produced during operation of the loudspeaker, so that the loudspeaker is free of accumulated heat and deformed or separated diaphragm due to operation for a prolonged time and could always maintain good sound quality.

As a component in a stereo sound system, a loudspeaker, or speaker, is actually a transducer that converts electrical energy into sound energy. Therefore, the loudspeaker has considerable influence on the quality of sound produced by the stereo sound system. Generally, a magnetic circuitry for a loudspeaker to operate includes at least a magnet, a voice coil, a diaphragm, a frame, an upper yoke (or ring-shaped yoke), and a lower yoke (or T-shaped yoke). According to a position of the magnet in the loudspeaker, loudspeakers are divided into two types, namely, internal-magnet and external-magnet speakers.

FIG. 1 is a sectioned side view of a conventional internal-magnet loudspeaker. The magnetic circuitry for this type of loudspeaker mainly includes a substantially U-shaped yoke 60 made of a magnetic conductive material, or soft iron, with an upper edge of the U-shaped yoke 60 bent radially inward, a magnet 61 positioned in the yoke 60, a bobbin 63 in a predetermined length provided above the magnet 61 to project from the upper edge of the yoke 60, and a voice coil 62 wound around the bobbin 63 to connect to a root portion of a diaphragm 64 without contacting with the magnet 61 at all. When the loudspeaker operates in a normal manner, the voice coil 62 is caused to move back and forth and therefore forces the diaphragm 64 to move back and forth at the same and thereby produces sound waves. Such continuous vibration (or work) of the voice coil 62 produces heat that accumulates in the U-shaped yoke 60. Since the voice coil 62 of an internal-magnet speaker is in a space enclosed by the U-shaped yoke 60 and a damper 65, the produced and accumulated heat is not easily diffused to dissipate. When the internally produced heat accumulates to a certain extent, it results in magnetic attenuation, particularly when a neodymium alnico magnet is used for the loudspeaker, and accordingly deteriorated sound quality. Another problem with the internal-magnet loudspeaker concerns the diaphragm 64. The diaphragm 64 is made of a resin material that tends to become softened at a raised temperature. A softened diaphragm 64 has shortened usable life and results in noises and undesired resonance during sound production. All these factors result in difficulties in designing a high-power loudspeaker and increased manufacturing cost thereof.

FIG. 2 is a sectioned side view of a conventional external-magnet loudspeaker. The magnetic circuitry for this type of loudspeaker includes a lower yoke 70 substantially in the shape of a reverted letter "T", a bobbin 71 formed from a central vertical portion of the T-shaped lower yoke 70, a voice coil 72 wound around the bobbin 71, a ring-shaped magnet 73 put around a lower part of the bobbin 71, and a damper 75 and a diaphragm 74 sequentially provided above the voice coil 72. As in the case of the internal-magnet loudspeaker, the voice coil 72 is in a space enclosed by the ring-shaped magnet 73 and the damper 75, resulting in accumulated heat in the magnet 73 that in turn causes magnetic attenuation and softened diaphragm 74 to increase difficulties in designing a high-power loudspeaker and manufacturing cost thereof.

SUMMARY OF THE INVENTION

It is therefore a primary object of the present invention to provide an open-type magnetic circuitry of loudspeaker that eliminates the problem of accumulated heat in a closed internal space of the loudspeaker.

Another object of the present invention is to provide an open-type magnetic circuitry of loudspeaker that allows a user to see from outside of the loudspeaker an entire working process of the magnetic circuitry, that is, the movement of the voice coil, giving the loudspeaker a novel appearance showing a high-tech touch.

To achieve the above and other objects, the open-type magnetic circuitry of loudspeaker of the present invention includes a lower yoke having a central portion upward projected to form a bobbin, a magnet positioned on top of the bobbin, a voice coil wound around the bobbin and the magnet, and a diaphragm connected at a root portion to the voice coil. The magnetic circuitry of loudspeaker is characterized in that the lower yoke is provided at an upper side surrounding the bobbin with a plurality of radially equally spaced supporting posts, a top end of which being higher than at least a bottom side of the magnet, and that a ring-shaped upper yoke having a central hole is covered onto the top end of the supporting posts, such that heat produced by the voice coil during working could quickly dissipate via a space between the upper and the lower yokes. Since no heat would accumulate in the loudspeaker, the loudspeaker could always maintain good sound quality.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
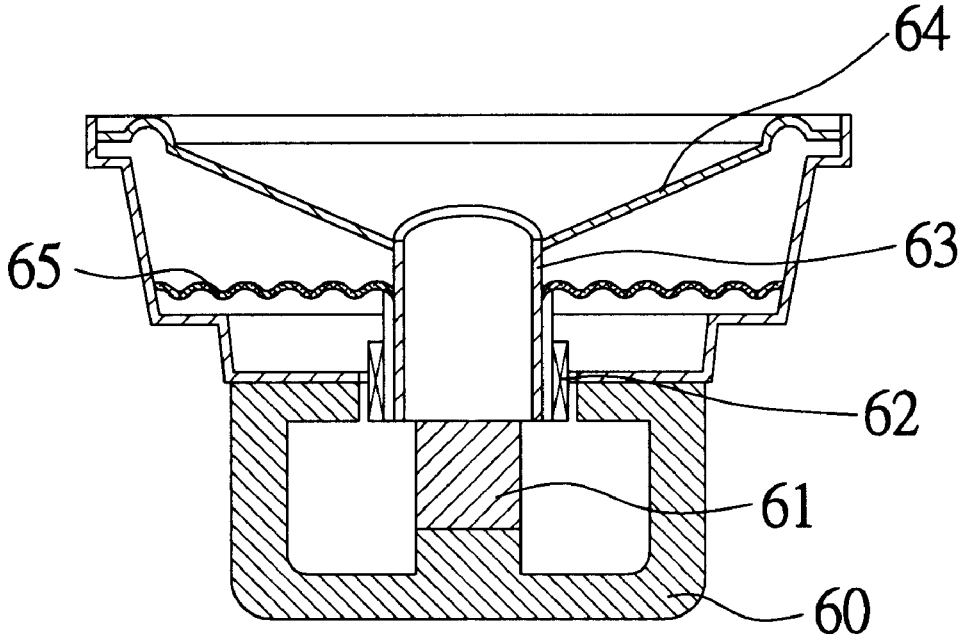
(PRIOR ART) Fig.1
FIG. 1 is a sectioned side view of a conventional internal-magnet loudspeaker.
Figure 2:
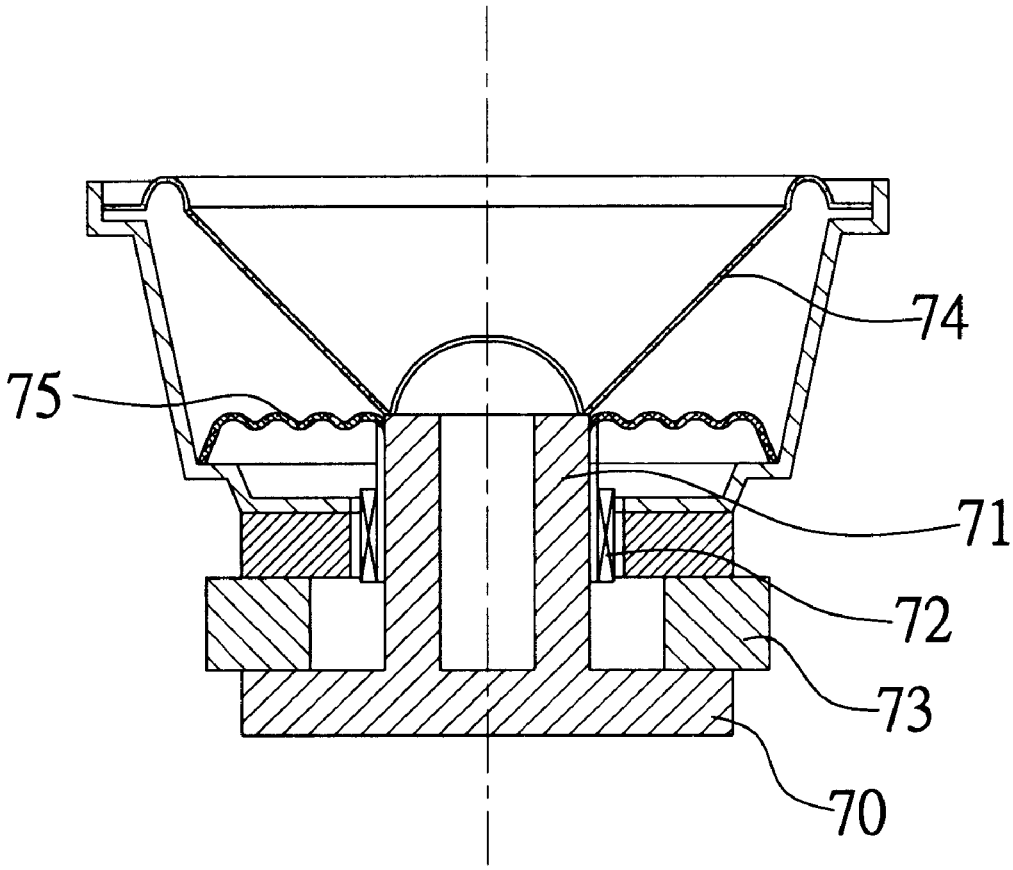
(PRIOR ART) Fig.2
FIG. 2 is a sectioned side view of a conventional external-magnet loudspeaker.
Figure 3:
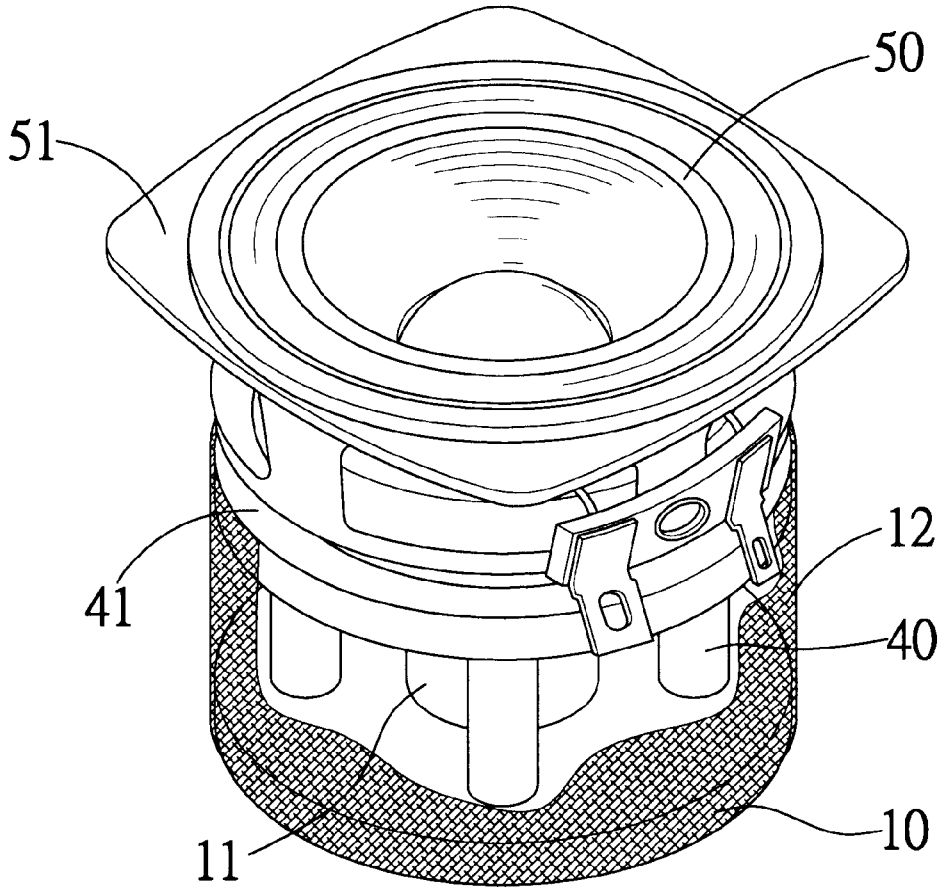
FIG. 3 is a perspective view of a loudspeaker having the open-type magnetic circuitry according to the present invention.
Figure 4:
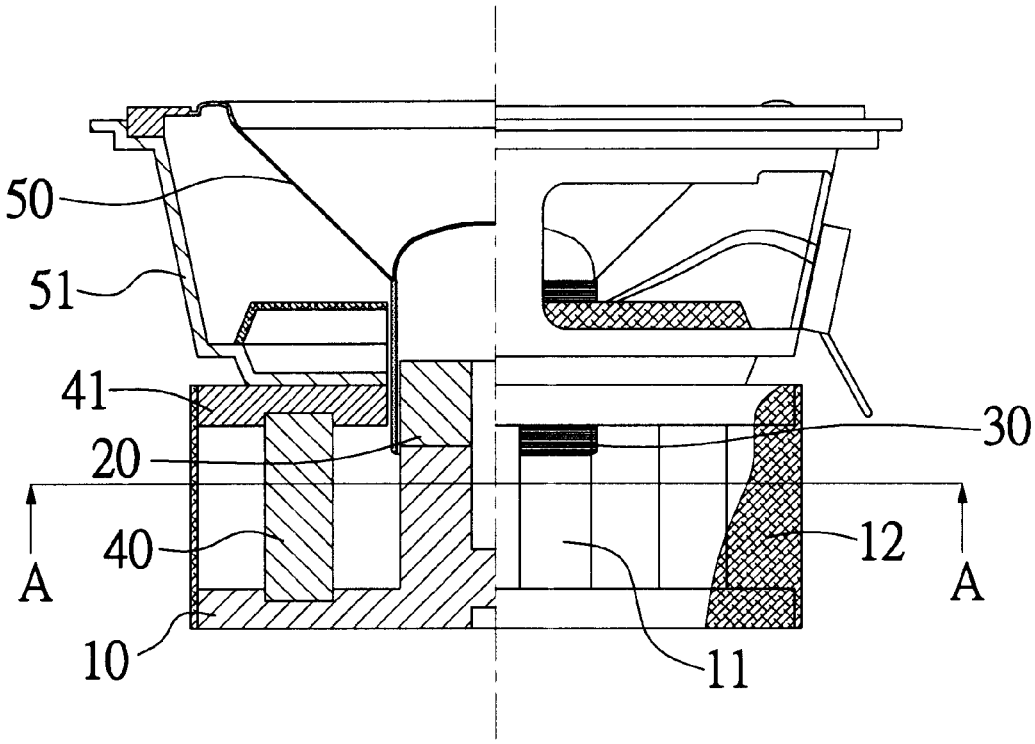
FIG. 4 is a partially sectioned side view of the loudspeaker of FIG. 3.

Please refer to FIGS. 3 and 4 that show a loudspeaker having an open-type magnetic circuitry according to the present invention. As shown, the open-type magnetic circuitry of loudspeaker includes a disc-shaped lower yoke 10 having a central portion upward projected by a predetermined length to form a bobbin 11, a magnet 20 positioned on top of the bobbin 11, and a voice coil 30 wound around the bobbin 11 and the magnet 20.

Figure 5:
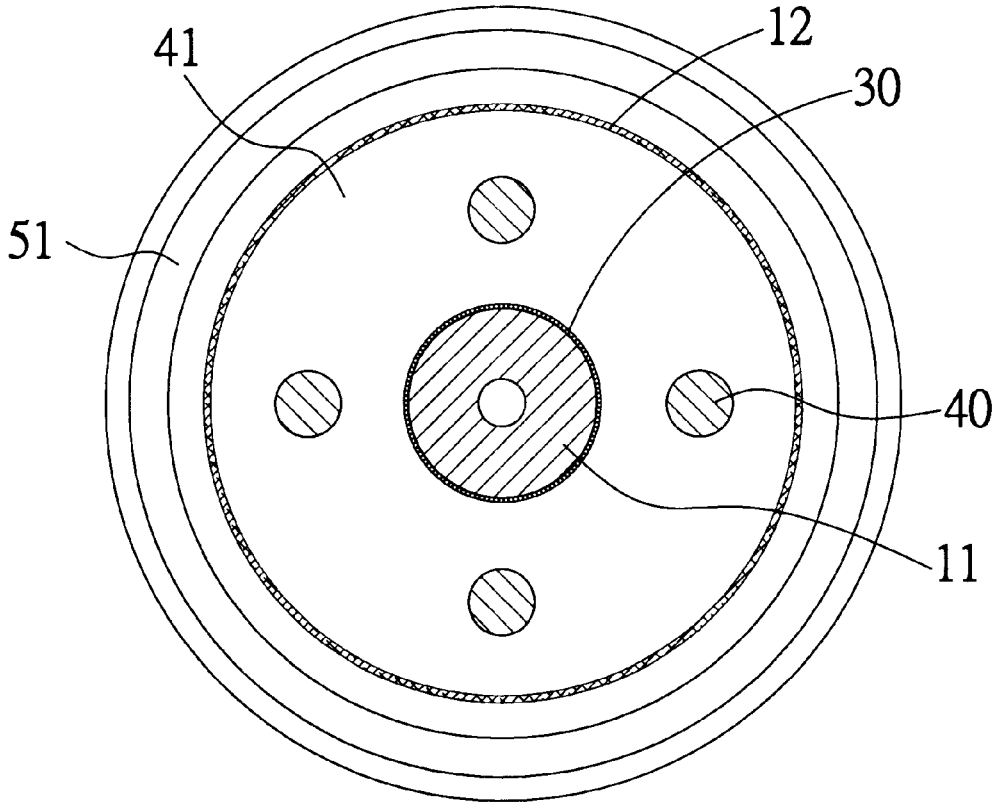
FIG. 5 is a cross section taken on line A—A of FIG. 4.

Please refer to FIGS. 4 and 5 at the same time. The lower yoke 10 is provided at an upper side surrounding the bobbin 11 with a plurality of radially equally spaced supporting posts 40. These posts 40 have a top end higher than at least a bottom side of the magnet 20. A ring-shaped upper yoke 41 is covered onto the top end of the posts 40. The voice coil 30 wound around the magnet 20 upward extends along a central hole of the ring-shaped upper yoke 41 to connect to a root portion of a diaphragm 50 of the loudspeaker. An upper frame 51 is provided around an outer side of the diaphragm 50 to connect at a lower part to the ring-shaped upper yoke 41, forming a complete housing for an upper part of the loudspeaker. Moreover, a net 12 with predetermined meshes is set either at an outer side or an inner side of the supporting posts 40 to enclose entire or a central part of an open space between the disc-shaped lower yoke 10 and the ring-shaped upper yoke 41 so as to effectively prevent dust and foreign matters from directly entering into the voice coil 30 while allowing the heat produced during normal operation of the loudspeaker to well radiate through good air convection. The loudspeaker could therefore have extended usable life.

With the above arrangements, heat produced by the voice coil 30 during operation of the loudspeaker at room temperature could radiate and dissipate into external environment via the space between the upper and the lower yokes and among the posts 40. The problem of accumulated heat inside the loudspeaker can therefore be thoroughly solved.

The following summarizes the advantages of the present invention over the conventional internal-magnet and external-magnet loudspeakers:

1. No heat would accumulate inside the loudspeaker to adversely affect a magnetic intensity thereof, enabling the loudspeaker to maintain an optimal condition to produce high sound quality. Moreover, with the present invention, it is possible to design a high-power loudspeaker without additional cost for extra components.
2. No heat would accumulate inside the loudspeaker to cause a softened diaphragm; the diaphragm could therefore have an extended usable life.
3. The net set at outer side or inner side of the supporting posts to enclose entire or a central part of the space between the upper and the lower yokes protects the voice coil against dust and foreign matters, making the loudspeaker perfect for operation.
4. The net set at outer side or inner side of the supporting posts to enclose entire or a central part of the spaces between the upper and the lower yokes allows a user to see from outside of the loudspeaker an entire process of movement of the voice coil, giving the loudspeaker a novel appearance showing a high-tech touch.

The present invention has been described with a preferred embodiment thereof and it is understood that many changes and modifications in the described embodiment can be carried out without departing from the scope and the spirit of the invention that is intended to be limited only by the appended claims.

What is claimed is:

1. An open-type magnetic circuitry of loudspeaker, comprising a lower yoke having a central portion upward projected by a predetermined length to form a bobbin, a magnet positioned on top of said bobbin, and a voice coil wound around said bobbin and said magnet; said magnetic circuitry being characterized in that said lower yoke is provided at an upper side surrounding said bobbin with a plurality of radially equally spaced supporting posts, a top end of which being higher than at least a bottom side of said magnet, that a ring-shaped upper yoke having a central hole is covered onto the top end of said supporting posts, so that said voice coil wound around said bobbin and said magnet upward extends along said central hole of said ring-shaped upper yoke to connect to a root portion of a diaphragm of said loudspeaker, and that an upper frame is provided around an outer side of said diaphragm to connect to said ring-shaped upper yoke to form a complete housing for an upper part of said loudspeaker.

2. The open-type magnetic circuitry of loudspeaker as claimed in claim 1, further comprising a net with predetermined meshes set at an outer side of said supporting posts to enclose an open space between said disc-shaped lower yoke and said ring-shaped upper yoke, so as to prevent dust and foreign matters from entering into said voice coil.

3. The open-type magnetic circuitry of loudspeaker as claimed in claim 1, further comprising a net with predetermined meshes set at an inner side of said supporting posts to enclose a central part of an open space between said disc-shaped lower yoke and said ring-shaped upper yoke, so as to prevent dust and foreign matters from entering into said voice oil.

* * * * *